US007209672B2

(12) United States Patent
Taguchi et al.

(10) Patent No.: US 7,209,672 B2
(45) Date of Patent: Apr. 24, 2007

(54) IMAGE FORMING APPARATUS AND AN IMAGE FORMING METHOD

(75) Inventors: Keiichi Taguchi, Nagano-ken (JP); Ken Yoshizuka, Nagano-ken (JP); Hiroshi Tanaka, Nagano-ken (JP); Osamu Ishibashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 11/067,593

(22) Filed: Feb. 25, 2005

(65) Prior Publication Data

US 2005/0196183 A1 Sep. 8, 2005

(30) Foreign Application Priority Data

Mar. 5, 2004 (JP) ..... 2004-061691
Mar. 5, 2004 (JP) ..... 2004-061694

(51) Int. Cl.
*G03G 15/00* (2006.01)
*G03G 15/08* (2006.01)

(52) U.S. Cl. ..... 399/12; 399/13; 399/27; 399/227

(58) Field of Classification Search ..... 399/12, 399/43, 38, 75, 76, 53, 13, 9, 227, 222, 223
See application file for complete search history.

(56) References Cited

U.S. PATENT DOCUMENTS

| | | | | |
|---|---|---|---|---|
| 6,889,024 | B2 * | 5/2005 | Shiraki et al. | 399/227 |
| 2004/0223787 | A1 * | 11/2004 | Shinohara et al. | 399/227 |
| 2005/0196181 | A1 * | 9/2005 | Taguchi et al. | 399/12 |
| 2005/0196182 | A1 * | 9/2005 | Taguchi et al. | 399/12 |

FOREIGN PATENT DOCUMENTS

| | | |
|---|---|---|
| JP | 2002-351190 | 12/2002 |
| JP | 2003-215862 | 7/2003 |

* cited by examiner

*Primary Examiner*—Sophia S. Chen
(74) *Attorney, Agent, or Firm*—Hogan & Hartson LLP

(57) ABSTRACT

Prior to execution of a printing operation and in parallel with a warm-up operation of the apparatus, a print preparatory operation is conducted only on selected cartridges of cartridges mounted to a developing unit, thereby bringing the cartridge into a printable state. Therefore, even if the residual amount of toner in one of the selected cartridges runs short, the printing operation is allowed to continue by switching this cartridge to the next selected cartridge.

14 Claims, 10 Drawing Sheets

FIG. 4

| | POSITIONING STATE OF DEVELOPING UNIT | OPERATION/PRINTABLE STATE |
|---|---|---|
| (a) | IMMEDIATELY AFTER START OF PRINT PREPARATORY PROCESS 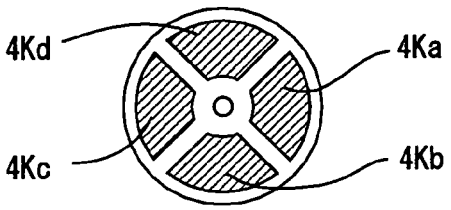  | CONDUCT ON CARTRIDGE 4Ka, 4Kb:<br>MOUNTING CONFIRMATION,<br>SUITABILITY CONFIRMATION, AND<br>LIFE CONFIRMATION |
| (b) | CARTRIDGE 4Ka: DEVELOPMENT POSITION 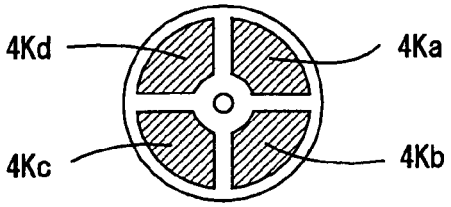  | CONDUCT ON CARTRIDGE 4Ka:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (c) | CARTRIDGE 4Kb: DEVELOPMENT POSITION 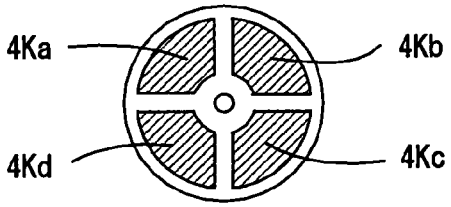  | CONDUCT ON CARTRIDGE 4Kb:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (d) | PRINT PREPARATORY PROCESS COMPLETED (HP) 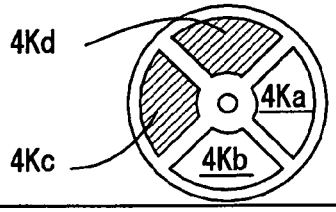  | BECOME PRINTABLE<br>BY SELECTED CARTRIDGES 4Ka, 4Kb |

FIG. 8

| | POSITIONING STATE OF DEVELOPING UNIT | OPERATION/PRINTABLE STATE |
|---|---|---|
| (a) | IMMEDIATELY AFTER START OF PRE-PRINT PROCESS<br>4Kd 4Ka 4Kc 4Kb | CHECK ALL CARTRIDGES 4Ka-4Kd TO DETERMINE WHETHER USABLE (OK) OR UNUSABLE (NG)<br>MOUNTING DETERMINATION, SUITABILITY DETERMINATION, AND LIFE DETERMINATION |
| (b) | IMMEDIATELY AFTER USABLE/UNUSABLE DETERMINATION<br>4Kd NG 4Ka OK OK 4Kc OK 4Kb | WHERE 3 CARTRIDGES 4Ka-4Kc ARE DETERMINED TO BE USABLE |
| (c) | CARTRIDGE 4Ka: DEVELOPMENT POSITION<br>4Kd NG OK 4Ka 4Kc OK OK 4Kb | CONDUCT ON CARTRIDGE 4Ka:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (d) | CARTRIDGE 4Kb: DEVELOPMENT POSITION<br>4Ka OK OK 4Kb 4Kd NG OK 4Kc | CONDUCT ON CARTRIDGE 4Kb:<br>AGITATION PROCESS, AND<br>AGITATION BY ROTATING DR<br>PATCH PROCESS<br>CALCULATION OF OPTIMUM DEVELOPING BIAS AND<br>CALCULATION OF OPTIMUM EXPOSURE POWER |
| (e) | PRE-PRINT PROCESS COMPLETED (HP)<br>4Kd NG OK 4Ka 4Kc 4Kb | BECOME PRINTABLE BY CARTRIDGES 4Ka, 4Kb |

IMAGE FORMING APPARATUS AND AN IMAGE FORMING METHOD

CROSS REFERENCE TO RELATED APPLICATION

The disclosure of Japanese Patent Applications No. 2004-61691 and No. 2004-61694 both filed Mar. 5, 2004 including specification, drawings and claims is incorporated herein by reference in its entirety.

BACKGROUND OF THE INVENTION

1. Field of the Invention

The present invention relates to an image forming apparatus and an image forming method performing a printing operation while selectively transferring one of plural cartridges having toner of a specific color to a development position, the printing operation performed using the toner in the cartridge positioned at the development position.

2. Description of the Related Art

Heretofore, there have been widely known image forming apparatuses adapted to form an image using a plurality of developer cartridges. For instance, Japanese Unexamined Patent Publication No. 2003-215862 discloses a color image forming apparatus including a rotary developing unit having four developer cartridges radially arranged about a rotating shaft. In this apparatus, the rotating shaft is driven into rotation for selectively positioning one of the four developer cartridges at a place opposite to a latent image carrier such as a photosensitive member so as to develop a latent image on the latent image carrier. Subsequently, the developed image is transferred to an intermediate transfer medium. The developing process and the transfer process are repeated the same way as the above while switching from one developer cartridge to another, whereby toner images of plural colors are superimposed on top of each other to form a color image.

In the aforementioned color image forming apparatus, the four developer cartridges contain therein toners of individually different colors (yellow, cyan, magenta and black) so as to perform the printing operation for color image. Therefore, there occurs a problem that in a case where the above image forming apparatus is used for printing monochromatic images, the above image forming apparatus runs out of the black toner faster than an image forming apparatus dedicated to monochromatic image printing. In order to overcome such a problem, there has been proposed an apparatus wherein black developer cartridge(s) is(are) mounted to place(s) where the yellow, cyan and/or magenta developer cartridge(s) are mounted, and wherein when one of the black developer cartridges runs out of the black toner, the developer cartridge is switched to another black developer cartridge so as to permit the continuation of the monochromatic printing operation (see, for example, Japanese Unexamined Patent Publication No. 2002-351190).

SUMMARY OF THE INVENTION

By the way, in order to ensure that the images are favorably printed using toner in a developer cartridge, it is necessary to conduct in advance a print preparatory operation on the developer cartridge. The print preparatory operation is typically exemplified by an optimization process (a patch process). According to the apparatus set forth in Japanese Unexamined Patent Publication No. 2003-215862, for example, the optimization process (equivalent to a "condition control process" of the present invention) is conducted at a proper time prior to the printing operation. For example, the optimization process may be conducted immediately after turn-on of the apparatus, after warm-up of the apparatus or in parallel with the warm-up of the apparatus. In the optimization process, optimum values of a developing bias and an exposure power, as density control factors affecting the image quality, are calculated based on detected densities of solid images or half-toned images formed as patch images. In the execution of the printing operation, the developing bias and the exposure power are set to the respective optimum values thus calculated. Thus are obtained the optimum printing operation conditions. Images of good and consistent quality may be formed by performing the printing operation under the printing operation conditions thus optimized. In view of the importance of the print preparatory operation, a variety of proposals have been made on the print preparatory operation in the color image forming apparatuses.

In contrast, the apparatus disclosed in Japanese Unexamined Patent Publication No. 2002-351190 or the apparatus provided with a plurality of developer cartridges containing the black toner does not give adequate consideration to the print preparatory process which is important in performing the favorable printing operation. The apparatus mounted with the plural black developer cartridges, for example, is capable of continuously producing a large volume of monochromatic prints by performing the monochromatic printing while selectively transferring one of the developer cartridges to the development position and using the toner contained in the cartridge positioned at the development position. When one developer cartridge is switched to another, however, if the print preparatory operation has not been conducted on the cartridge to be positioned at the development position, the print preparatory operation must be conducted on the cartridge before the printing operation is performed using the cartridge. Hence, the monochromatic printing is temporarily interrupted. In consequence, a problem may occur that a large volume of prints cannot be produced efficiently.

In this connection, it may be contemplated to apply the optimization process set forth in, for example, Japanese Unexamined Patent Publication No. 2003-215862 as is to the optimization process for the cartridges mounted to the developing unit. In other words, the optimization process is conducted on the developer cartridge positioned at the development position while transferring each of the cartridges mounted to the developing unit to the development position in turn. Accordingly, in a case where the yellow, cyan and magenta developer cartridges are all replaced by the black developer cartridges, the optimization process is repeated in four cycles before the printing operation is performed.

However, since the printing operation is not able to be performed until the optimization processes on all the developer cartridges is completed as described above there was a case that a user was compelled to wait needlessly long until a start of printing. For example, let us consider a case where, as described above, the optimization process is conducted in parallel with the warm-up operation immediately after turn-on or at reversion to normal mode from a sleep mode (print stand-by state). An efficient use of time is thus accomplished by conducting the optimization process in parallel with the warm-up operation. However, the increase of the number of developer cartridges, as an object of the optimization process, leads to the corresponding increase of the total length of time required for the optimization process, which may result in a case where some of the developer cartridges are not yet finished with the optimization process when the warm-up operation is completed. In such a case, the printing operation cannot be started till the completion of the optimization process on the remaining cartridge(s), although it is possible to start the printing operation using the developer cartridge already finished with the optimization process. Therefore, a mere combination of prior arts is difficult to meet in a balances manner the demands of printing a great amount and of shortening time required to become into a printable state.

Further, the execution of the print preparatory operation on the developer cartridge mounted to the developing unit does not always enable the printing using the developer cartridge, because it is practically impossible to perform the printing operation if, for example, a required amount of toner for performing the printing operation does not remain in the cartridge mounted to the developing unit. Therefore, the execution of the print preparatory operation on the developer cartridge, which is not usable for printing, leads to the waste of time and electric power, and is inefficient in terms of time and economy.

The present invention has been accomplished in light of the foregoing problem. It is an object of the invention to permit an image forming apparatus to print in a specific color a great amount in an efficient manner and to bring the apparatus into a printable state in the specific color in a short time, the apparatus capable of performing a printing operation while selectively transferring one of plural cartridges having toner of the specific color to a development position, the printing operation performed using the toner contained in the cartridge positioned at the development position.

According to a first aspect of the present invention, there is provided an image forming apparatus, comprising: a latent image carrier capable of carrying thereon an electrostatic latent image; a developing unit having a plurality of cartridges which are freely mounted to and removed from said developing unit and which contain toner of a specific color; and a controller which performs a printing operation to selectively position one of the plurality of cartridges mounted to said developing unit at a development position and to develop the electrostatic latent image on said latent image carrier using the toner in the cartridge positioned at the development position, wherein said controller defines N ($M>N\geqq 2$) cartridges out of M ($M\geqq 3$) cartridges mounted to said developing unit as selected cartridges and conducts a print preparatory operation prior to the printing operation only on the selected cartridges, the print preparatory operation conducted on the cartridges in order to enable the printing operation by means of the cartridges.

According to a second aspect of the present invention, there is provided an image forming method of an apparatus which comprises a latent image carrier capable of carrying thereon an electrostatic latent image, and a developing unit having a plurality of cartridges which are freely mounted to and removed from said developing unit and which contain toner of a specific color, said method comprising: a step of executing a printing operation to selectively position one of the plurality of cartridges mounted to said developing unit to a development position, and to develop the electrostatic latent image on said latent image carrier using the toner in the cartridge positioned at the development position, a step of defining N ($M>N\geqq 2$) cartridges out of M ($M\geqq 3$) cartridges mounted to said developing unit as selected cartridges prior to the printing operation, and a step of conducting a print preparatory operation prior to the printing operation only on the selected cartridges, the print preparatory operation conducted to enable the printing operation by means of the cartridges.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 4 is a schematic diagram showing a print preparatory operation.

FIG. 8 is a schematic diagram showing a pre-print operation conducted in the second embodiment.

DETAILED DESCRIPTION OF THE PREFERRED EMBODIMENT

<First Embodiment>

Now referring to the accompanying drawings, description is made on an embodiment of the present invention implemented in the image forming apparatus (color printer) disclosed in Japanese Unexamined Patent Publication No. 2003-215862. In other words, in this embodiment, the description is made on a specific example in a single color printing or monochromatic printing using black toner contained in four developer cartridges.

Figure 1:
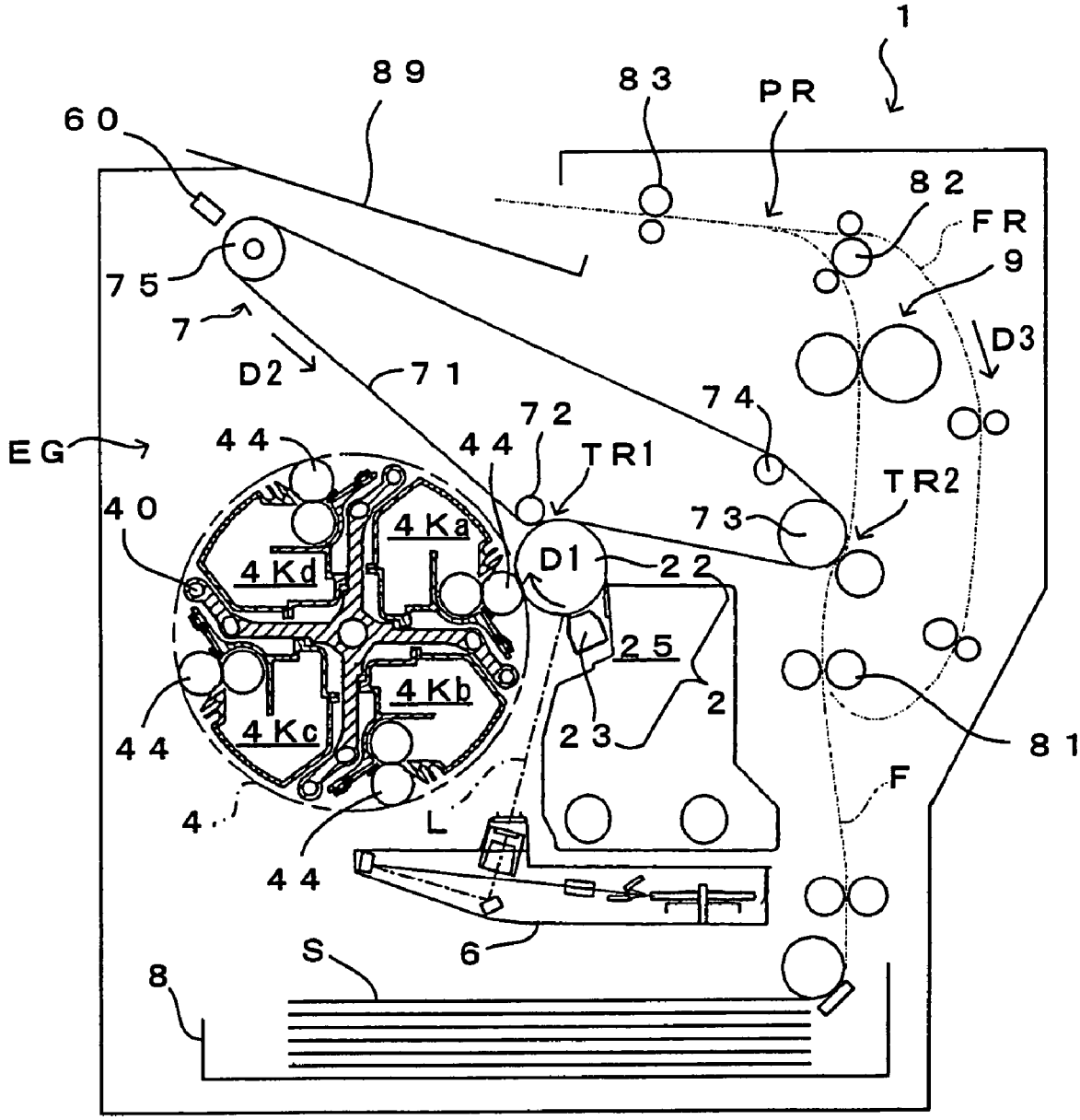
FIG. 1 is a diagram showing a preferred embodiment of an image forming apparatus according to the present invention.
Figure 2:
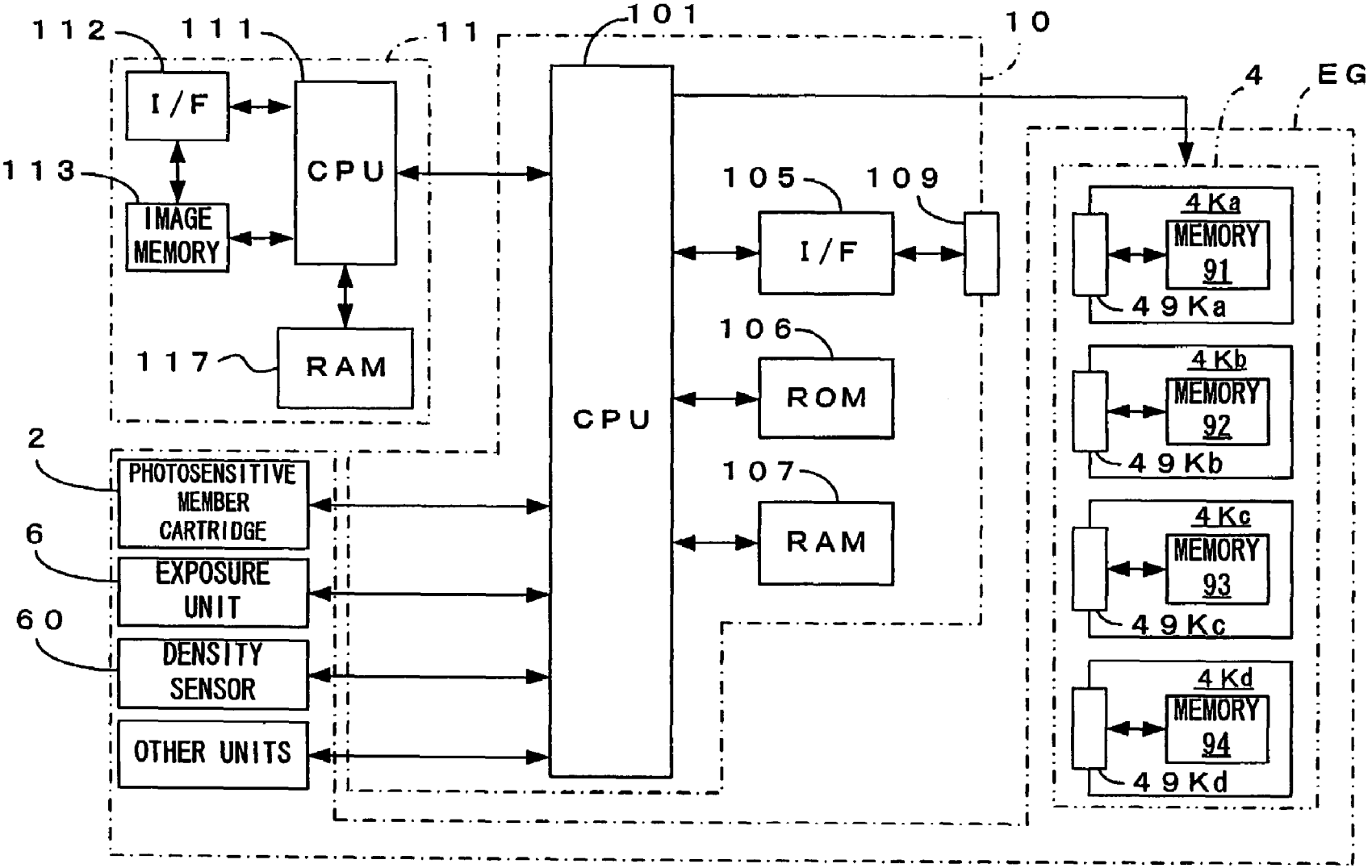
FIG. 2 is a block diagram showing an electrical arrangement of the image forming apparatus of FIG. 1.

FIG. 1 is a diagram showing a preferred embodiment of an image forming apparatus according to the present invention. FIG. 2 is a block diagram showing an electrical arrangement of the image forming apparatus of FIG. 1. The apparatus 1 is an image forming apparatus operative to form monochromatic images using only the black (K) toner. In this image forming apparatus 1, when an image signal is supplied to a main controller 11 from an external apparatus such as a host computer, an engine controller 10 responds to a command from the main controller 11 so as to execute a predetermined image forming operation by controlling individual parts of an engine section EG, thereby forming on a sheet S a monochromatic image corresponding to the image signal.

The engine section EG is provided with a photosensitive member 22 which is rotatable in a direction DI of an arrow in FIG. 1. A charger unit 23, a rotary developing unit 4 and a cleaner 25 are disposed around the photosensitive member 22 along the direction DI of the rotation thereof. The charger unit 23 is applied with a predetermined charging bias for uniformly charging an outer circumferential surface of the photosensitive member 22 to a predetermined surface potential. The cleaner 25 operates to remove remaining toner from the surface of the photosensitive member 22 after a primary image transfer to be described hereinlater, and to collect the removed toner in a waste toner tank disposed therein. The photosensitive member 22, the charger unit 23 and the cleaner 25 integrally constitute a photosensitive member cartridge 2. The photosensitive member cartridge 2, as a unit, is freely mounted to and removed from a main body of the apparatus 1.

A light beam L from an exposure unit 6 is irradiated on the outer circumferential surface of the photosensitive member 22 thus charged by the charger unit 23. The exposure unit 6 irradiates the light beam L on the photosensitive member 22 according to the image signal applied from the external apparatus, thereby forming an electrostatic latent image corresponding to the image signal. In the embodiment, thus, the photosensitive member 22 is equivalent to a "latent image carrier" of the present invention.

The electrostatic latent image thus formed is developed with toner by means of the developing unit 4. The developing unit 4 includes a support frame 40 freely rotatable about a rotating shaft perpendicular to the plane of FIG. 1, four developer cartridges 4Ka to 4Kd each structured as a cartridge free to be mounted to or removed from the support frame 40 and each containing therein the black toner, and a rotary driver (not shown) for driving these components into unitary rotation. The developing unit 4 is controlled by the engine controller 10. Based on a control command from the engine controller 10, when the developing unit 4 is driven into rotation and any one of the developer cartridges 4Ka to 4Kd is selectively positioned at a predetermined development position which is an abutting position against the photosensitive member 22 or an opposed position against the photosensitive member 22 via a predetermined gap therebetween, a developing roller 44 disposed in the developer cartridge thus positioned supplies the toner to the surface of the photosensitive member 22. Thus, the electrostatic latent image on the photosensitive member 22 is developed with the toner contained in the selected developer cartridge (printing operation). Thus, the visualization of the electrostatic latent image by means of the developer cartridge positioned at the development position is equivalent to a "printing operation by means of the cartridge" of the present invention.

The toner image developed by the developing unit 4 in the aforementioned manner is primarily transferred onto an intermediate transfer belt 71 of a transfer unit 7 at a primary transfer region TR1. The transfer unit 7 includes the intermediate transfer belt 71 stretched across a plurality of rollers 72 to 75, and a driver which drives the roller 73 into rotation thereby revolving the intermediate transfer belt 71 in a predetermined revolving direction D2. The transfer unit 7 forms a monochromatic image by transferring the black toner image formed on the photosensitive member 22 onto the intermediate transfer belt 71 and then, secondarily transfers the monochromatic image onto a sheet S which is picked up from a cassette 8 one by one and is transported along a transportation path F to a secondary transfer region TR2.

In this process, timing of feeding the sheet S to the secondary transfer region TR2 is controlled so as to transfer the image on the intermediate transfer belt 71 onto the sheet S exactly at a predetermined position. Specifically, a gate roller 81 is provided on the transportation path F at a place upstream from the secondary transfer region TR2 and as the gate roller 81 is rotated in synchronization to the timing of the revolving movement of the intermediate transfer belt 71, the sheet S is fed into the secondary transfer region TR2 at a predetermined timing.

Further, the sheet S now bearing the monochromatic image is transported to a discharge tray 89, which is disposed at a top side portion of the apparatus main body, via a fixing unit 9, a pre-discharge roller 82 and a discharge roller 83. In a case where images are formed on the both sides of the sheet S, the rotation of the discharge roller 83 is reversed at the point of time that a trailing end of the sheet S with the image thus formed on one side thereof is transported to a reversal position PR downstream from the pre-discharge roller 82. Thus, the sheet S is transported along a reversal transport path FR in a direction of an arrow D3. Thereafter, the sheet S is loaded again on the transportation path F at a place upstream from the gate roller 81. At this time, the sheet S is positioned such that the opposite side from the side to which the image is previously transferred is to be pressed against the intermediate transfer belt 71 for image transfer in the secondary transfer region TR2. It is possible to form images on the both sides of the sheet S in this manner.

Further, a density sensor 60 is disposed in proximity of the roller 75. The density sensor 60 confronts a surface of the intermediate transfer belt 71 and measures, as needed, an image density of the toner image formed on an outside surface of the intermediate transfer belt 71. Based on the measurement results, the apparatus adjusts the operating conditions, for example, the developing bias applied to each developer cartridge, the intensity of the light beam L and the like, of the individual parts thereof which may affect the image quality.

The density sensor 60 is arranged to output a signal corresponding to an image density of a region of a given area on the intermediate transfer belt 71 using a reflective photosensor, for example. A CPU 101 is adapted to detect image densities of individual parts of the toner image on the intermediate transfer belt 71 by periodically sampling the output signals from the density sensor 60 while moving the intermediate transfer belt 71 in revolution.

Further, as shown in FIG. 2, the developer cartridges 4Ka to 4Kd are provided with memories 91 to 94, respectively, each memory storing data relating to the production lot, operation history of the developer cartridge, the residual quantity of toner contained therein, and the like. The developer cartridges 4Ka to 4Kd are further provided with wireless communication devices 49Ka, 49Kb, 49Kc, 49Kd, respectively. Whenever necessary, a selected one of these communication devices performs non-contact data communications with a wireless communication device 109 disposed in the main body, and the data transmission/reception via an interface 105 is carried out between the CPU 101 and each of the memories 91 to 94, thereby managing a variety of information items, such as an information item on a consumable article and the like of the developer cartridge. In the embodiment, the non-contact data transmission/reception is carried out by using electromagnetic means such as a wireless communication device. Alternatively, the main body and the individual developer cartridges may be provided with connectors or the like and a respective pair of corresponding connectors may be mechanically fitted with each other for transmitting the data with each other.

In FIG. 2, a reference symbol 113 represents an image memory disposed in the main controller 11 for storing an image supplied from the external apparatus such as a host computer via an interface 112. A reference symbol 117 represents a RAM for temporarily storing operation results given by a CPU 111 and other data. A reference symbol 106 represents a ROM for storing an operation program executed by the CPU 101, control data used for controlling the engine section EG, and the like. A reference symbol 107 represents a RAM for temporarily storing operation results given by the CPU 101 and other data.

By the way, in the apparatus arranged as described above, it is necessary to conduct a print preparatory operation prior to the execution of the printing operation by means of each of the developer cartridges 4Ka to 4Kd. The "print preparatory operation" means an operation or a process to be conducted on the developer cartridges 4Ka to 4Kd prior to the execution of the printing operation in order to enable the printing operation by means of each of the developer cartridges 4Ka to 4Kd. In this embodiment, the following operations and processes are conducted as the "print preparatory operation".

(1) Mounting Confirmation Operation

The mounting confirmation operation is an operation to confirm that the developer cartridges are assuredly mounted to the support frame 40 of the developing unit 4. Specifically, the confirmation is made based on data transmission/reception between the CPU 101 and the individual memories 91 to 94 via the wireless communications carried out between the main body and the individual developer cartridges. In this respect, (2) suitability confirmation operation to be described below is performed the same way. It goes without saying that the mounting of the developer cartridges may also be confirmed by means of a contact system employing a limit switch or the like, instead of using the non-contact system like that of the wireless communications.

(2) Suitability Confirmation Operation

The suitability confirmation operation is an operation to confirm that the developer cartridges mounted to the support frame 40 of the developing unit 4 are the developer cartridges containing therein the black toner. According to the embodiment in particular, the monochromatic image forming apparatus is constituted by mounting the black developer cartridge(s) to mounting position(s) for yellow, cyan and/or magenta developer cartridge(s) which are for use in the color image forming apparatus. Accordingly, the embodiment involves a possibility of a user, operator or the like inadvertently mounting a wrong developer cartridge. On this account, the suitability confirmation operation is conducted to prevent the yellow, cyan or magenta developer cartridge from being mistakenly used.

(3) Life Confirmation Operation

The life confirmation operation is an operation to confirm that a required amount of toner for performing the printing operation remains in the cartridge mounted to the support frame 40 of the developing unit 4. The occurrence of defects, such as density variations or thin spots in the image formed by the printing operation is obviated by conducting the life confirmation operation.

(4) Agitation Process

The agitation process is a process to cause the developing roller 44 equivalent to the "toner carrier" of the present invention to rotate at least one round. The following is the reason for conducting the agitation process. It has heretofore been known that the image forming apparatus of this type may sometimes encounter the occurrence of periodical density variations in an image when the printing operation is performed after a long period during which the apparatus is turned off or in a standstill where the apparatus does not perform the printing operation (image forming operation) although the power is on. It is noted that this phenomenon is referred to as "shutdown-induced banding phenomenon" in this specification.

The shutdown-induced banding phenomenon is thought to result from the fact that since the toner is left to stand for long hours being carried on the developing roller 44 of each developer cartridge, the toner becomes inseparable from the developing roller 44, and besides, the toner on a surface of the developing roller 44 exhibits various degrees of inseparability so that the toner layer on the developing roller 44 is gradually varied in thickness. Consequently, in the image forming apparatus of this embodiment, an "agitation demanding" signal is generated to cause the developing roller 44 to idle when a condition of arising the shutdown-induced banding phenomenon is satisfied, like when the duration of the standstill exceeds a predetermined time period. Specifically, a rotary driver (not shown) in the main body causes the developing roller 44 to rotate at least one round. Thus, since the toner layer on the surface of the developing roller 44 is refreshed so that a toner layer of a more consistent thickness may be used for the developing process, the density variations due to the shutdown-induced banding phenomenon are less likely to occur.

(5) Patch Process (Condition Control Process)

The patch process is an optimization process to adjust a printing operation condition to a predetermined optimum condition, the printing operation condition under which the printing operation is performed by means of the developing cartridge. This process is the same as those that have heretofore been used widely in the art for stabilizing the image quality. In this embodiment, a "patch control demanding" signal is generated at a suitable time immediately after turn-on of the apparatus so as to carry out the patch process in parallel with the warm-up of the apparatus. In addition, the "patch control demanding" signal is also generated at time when the sleep mode is cancelled, when an opened apparatus cover is closed, or when an operation of replacing the developer cartridge is completed, thus demanding the execution of the patch process.

Next, a print preparatory process conducted prior to the printing process in the apparatus shown in FIG. 1 is described with reference to FIGS. 3 through 6. In the interest of promoting the comprehension of the contents of the invention, the description is made on the case where, as shown in FIG. 1, the four developer cartridges 4Ka to 4Kd are mounted to the developing unit 4.

Figure 3:
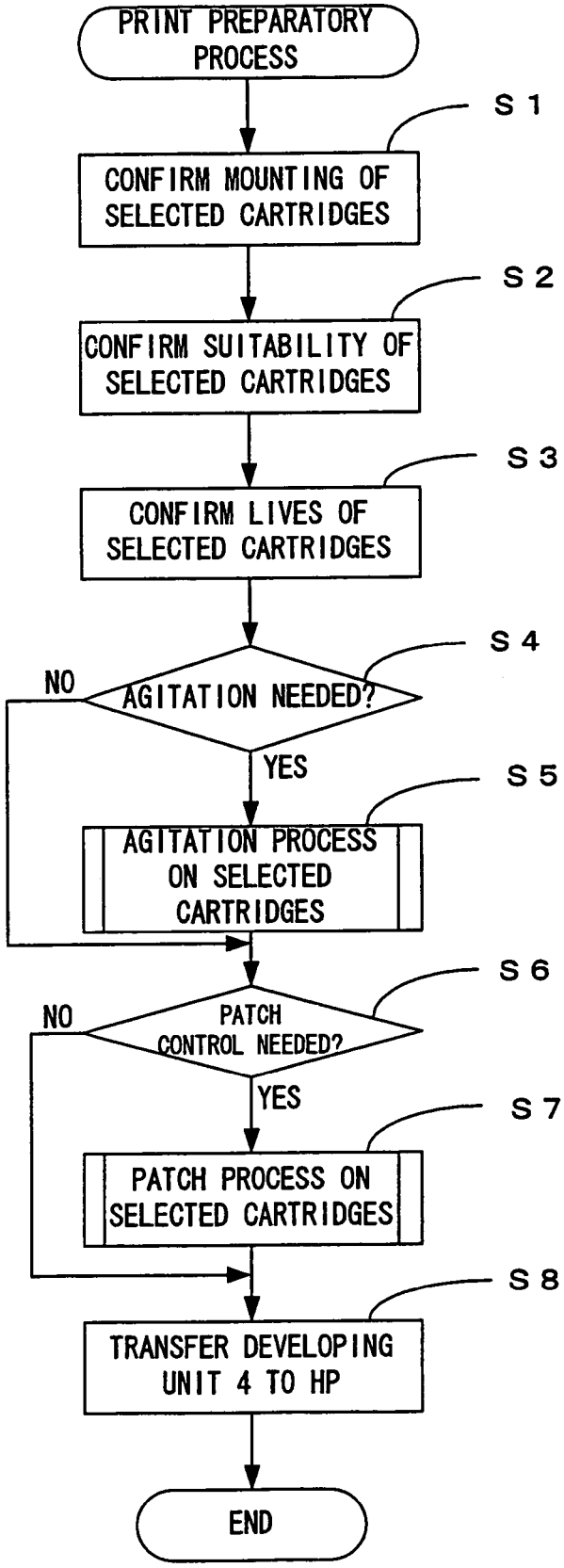
FIG. 3 is a flow chart showing a print preparatory process conducted in the image forming apparatus of FIG. 1.

FIG. 3 is a flow chart showing a print preparatory process conducted in the image forming apparatus of FIG. 1. FIG. 4 is a schematic diagram showing the print preparatory operation. In this apparatus, at a proper time prior to the execution of the printing operation, for example, immediately after the turn-on of the apparatus, the CPU 101 controls the individual parts of the apparatus based on the program stored in the ROM 106 thereby carrying out the print preparatory process shown in FIG. 3 in parallel with the warm-up operation of the apparatus. That is, in this embodiment, the CPU 101 functions as a "controller" of the present invention.

First, the data transmission/reception between the CPU 101 and each of the memories 91 to 94 is carried out via the wireless communications, so that a variety of information items, such as the consumable article management, relating to the individual developer cartridges 4Ka to 4Kd are temporarily stored in the RAM 107. Based on the information stored in the memory 107, the developer cartridge 4Ka located closest to the development position among the mounted cartridges 4Ka to 4Kd, and the developer cartridge 4Kb adjoining the developer cartridge 4Ka are defined as the "selected cartridges" of the present invention. Then, the mounting confirmation operation (Step S1), the suitability confirmation operation (Step S2) and the life confirmation operation (Step S3) are conducted on the selected cartridges 4Ka, 4Kb (column (a) of FIG. 4).

In Step S4, determination is made as to whether the "agitation demanding" signal is generated or not. This is a process for preventing the shutdown-induced banding phenomenon. Therefore, if the "agitation demanding" signal is not generated, the control proceeds directly to Step S6, and if the signal is generated on the other hand, the agitation process shown in FIG. 5 is conducted on the selected cartridges 4Ka, 4Kb (Step S5).

Figure 5:
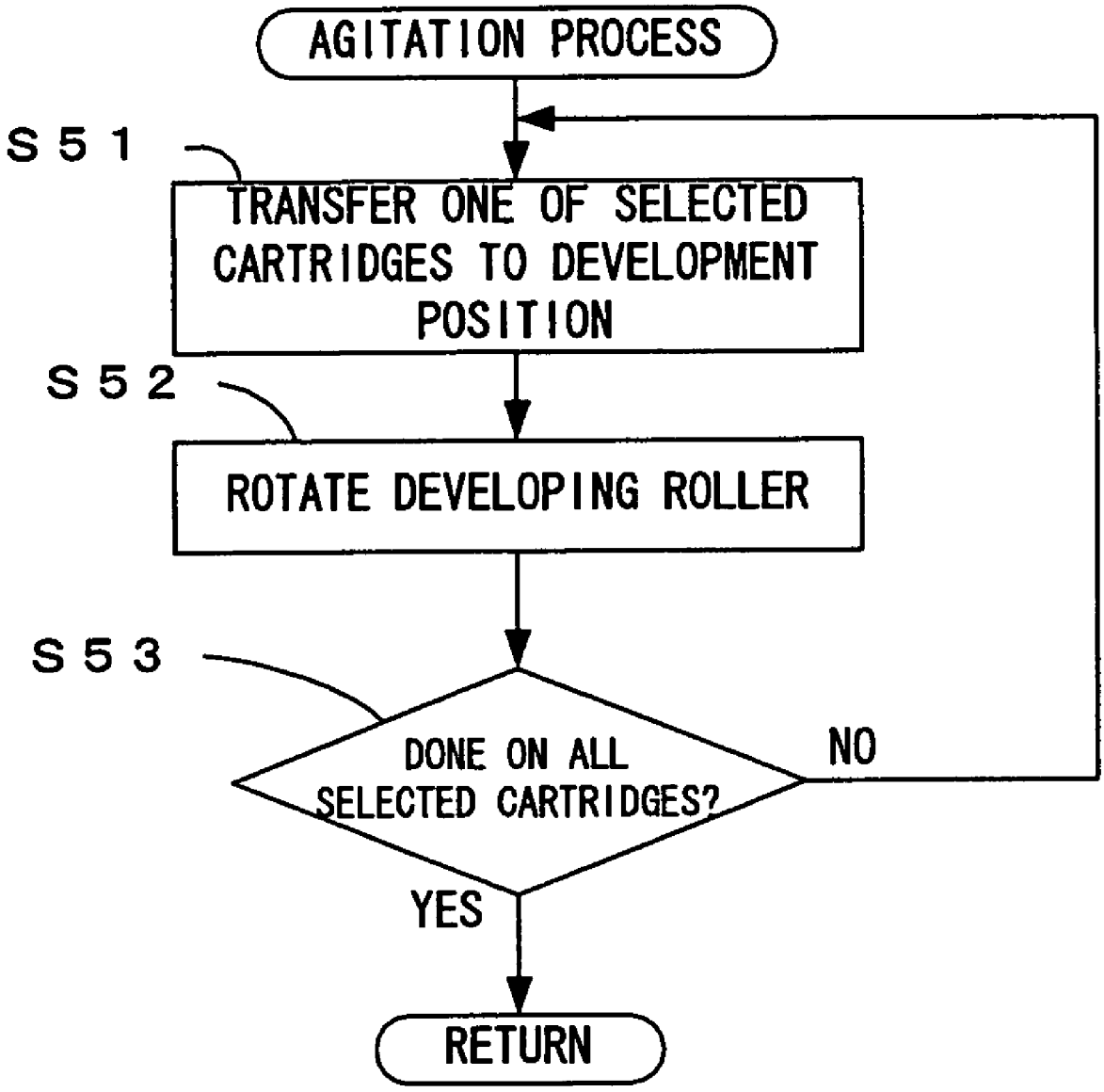
FIG. 5 is a flow chart showing an agitation process conducted in the apparatus of FIG. 1.

FIG. 5 is a flow chart showing the agitation process conducted in the apparatus of FIG. 1. In the agitation process, as shown in column (b) of FIG. 4, the first developer cartridge 4Ka of the two selected cartridges is transferred to the development position (Step S51). This brings the developing roller 44 (DR in column (b) of FIG. 4) of the developer cartridge 4Ka into mechanical connection with the rotary driver in the main body. The rotary driver causes the developing roller 44 to rotate at least one round so as to refresh the toner layer on the surface of the developing roller 44, thereby conducting the agitation process on the developer cartridge 4Ka (Step S52). The operations of Steps S51 and S52 are repeated so long as the result of the determination in Step S53 is "NO". Specifically, after the termination of the agitation process on the developer cartridge 4Ka, the developer cartridge 4Kb is transferred to the development position where the developing roller 44 of the developer cartridge 4Kb is caused to rotate at least one round (column (c) of FIG. 4).

When the agitation process (Step S5) is thus completed, the control proceeds to Step S6 to determine whether the "patch control demanding" signal is generated or not. This is a process to adjust the printing operation condition to the predetermined optimum condition. Therefore, if the "patch control demanding" signal is not generated, after the developing unit 4 is transferred to HP (Step S8), the print preparatory process is terminated, and if the signal is generated on the other hand, the patch process shown in FIG. 6 is conducted on the selected cartridges 4Ka, 4Kb (Step S7).

Figure 6:
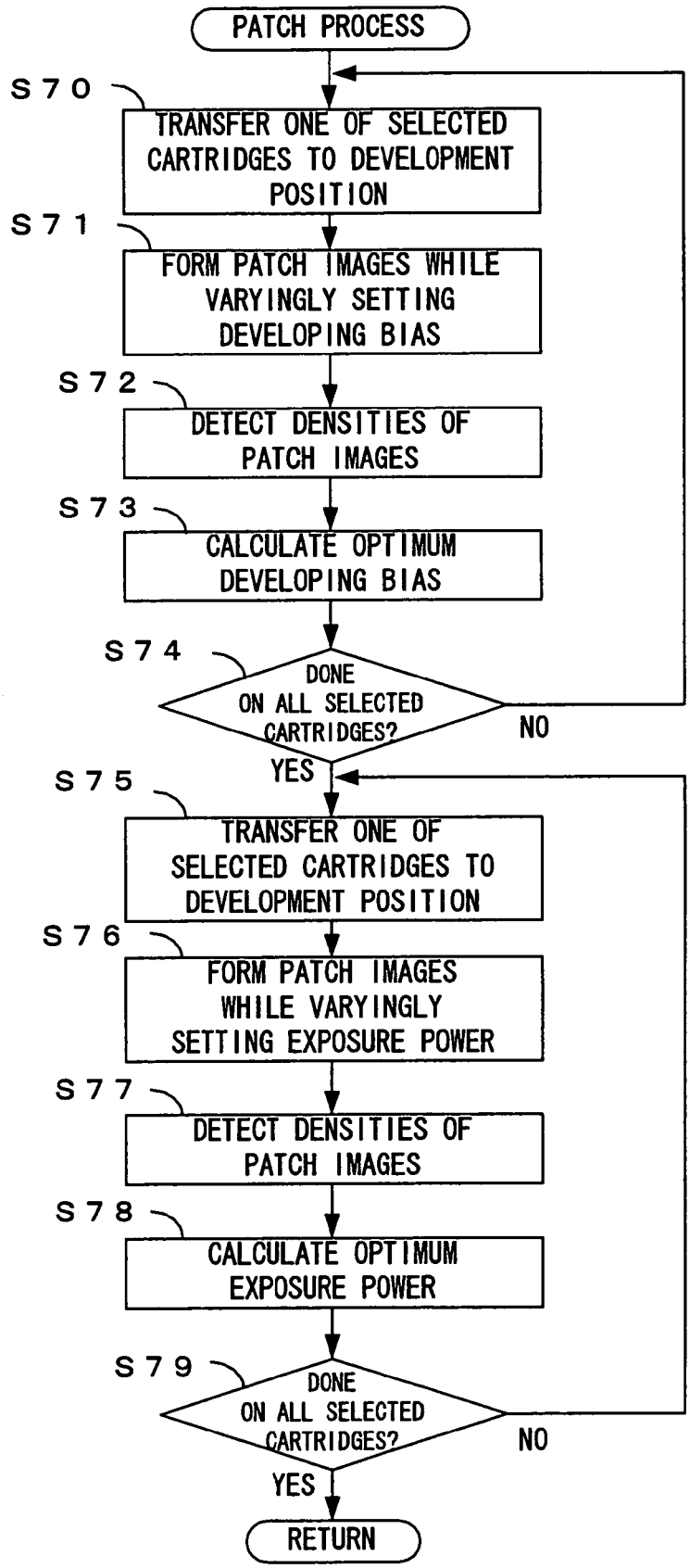
FIG. 6 is a flow chart showing a patch process conducted in the apparatus of FIG. 1.

FIG. 6 is a flow chart showing the patch process conducted in the apparatus of FIG. 1. The patch process is a process, in order to maintain a certain quality of the images formed by performing the printing operation, to form individual patch images while setting the printing operation condition varyingly in different values, to detect the image densities of the formed images, and to adjust the printing operation condition based on the detection results. In this patch process, out of the operation parameters which determine the operating conditions of the individual parts of the apparatus, the developing bias and the exposure power, as the control factors affecting the image quality, are adjusted. In addition to these parameters, there are known other various operation parameters which function as the control factors. Since there are a large number of known techniques relating to the principles of the image quality control and the control method using these operation parameters, only the flow of the process is briefly described here.

First, for each of the developer cartridges 4Ka and 4Kb, calculated is the optimum developing bias, that is, the optimum value of the developing bias to be applied to the developing roller 44 during the printing operation. Specifically, as shown in column (b) of FIG. 4, one developer cartridge 4Ka of the selected developer cartridges 4Ka, 4Kb is selectively transferred to the development position (Step S70). While setting the developing bias varyingly in multiple levels, each of the patch images of a predetermined pattern is formed with each level of the developing bias by means of the developer cartridge 4Ka (Step S71). Then, the image density of each of the patch images is detected by means of the density sensor 60 (Step S72).

When the image densities of the individual patch images are determined, the corresponding relation between the developing bias and the image density can be determined from these values. Hence, such a value of the developing bias as to match the image density with a predetermined target density is calculated based on the relation thus determined. Thus is determined the optimum developing bias (Step S73). It is noted however that if the calculated optimum value is not within the variable range of the developing bias of the apparatus, any one of the values in the variable range that is the closest to the calculated optimum value may be defined as the optimum developing bias.

After the optimum developing bias for one developer cartridge 4Ka is thus determined, the above operations S70 to S73 are repeated till the termination of the process on all the selected cartridges (Step S74). Specifically, the developer cartridge 4Kb is transferred to the development position to determine the optimum developing bias for the cartridge (column (c) of FIG. 4). In this manner, the optimum developing bias is determined for each of the developer cartridges 4Ka and 4Kb.

Subsequently, for each of the developer cartridges 4Ka and 4Kb, calculated is the optimum exposure power, that is, the optimum value of the intensity of the light beam L in forming, on the photosensitive member 22, the electrostatic latent image corresponding to the cartridge (Steps S75 to S79). This process is conducted the same way as the aforementioned process for calculating the optimum developing bias (Steps S70 to S73), except that the control factor is the exposure power instead of the developing bias. However, the image pattern of the patch images to be formed may be changed to a different one, if it is necessary. It is noted that this process may preferably set the developing bias to the previously determined optimum value thereof. In this manner, the optimum developing bias and the optimum exposure power for all the selected cartridges 4Ka and 4Kb are determined respectively, and the patch process is terminated.

By conducting such a print preparatory operation (the mounting confirmation operation, the suitability confirmation operation, the life confirmation operation, the agitation process, the patch process), as shown in column (d) of FIG. 4, all the selected cartridges 4Ka, 4Kb are placed in the printable state in which the printing operation is conducted satisfactory. Now returning to FIG. 3, the developing unit 4 is transferred to the home position (HP) and stands ready (Step S8). Then, the execution of the image forming operation by the engine section EG is permitted. The subsequent printing operation is performed under the optimum conditions, thereby ensuring that the images of a desired image quality can be formed in a stable manner.

As described above, according to this embodiment, out of the four developer cartridges 4Ka to 4Kd mounted to the developing unit 4, the two developer cartridges 4Ka, 4Kb are defined as the selected cartridges, and the print preparatory operation is conducted only on the selected cartridges 4Ka, 4Kb prior to the execution of the printing operation, thereby bringing the selected cartridges 4Ka, 4Kb into the printable state. Therefore, even if the residual quantity of toner contained in the cartridge 4Ka runs too low to continue the printing operation while performing the printing operation using the developer cartridge 4Ka which is one of the selected cartridges 4Ka, 4Kb on which the print preparatory operation has been already conducted, for example, it is possible to continue the printing operation by immediately switching to the developer cartridge 4Kb. Thus, since the print preparatory operation is previously conducted on the selected cartridges 4Ka and 4Kb, it is possible to continue the printing operation using the toner contained in each of the selected cartridges while selectively switching from one to the other of the selected cartridges 4Ka and 4Kb. Accordingly, a large volume of monochromatic prints can be produced efficiently.

Further, in parallel with the warm-up operation of the apparatus, the print preparatory operation is conducted only on the two selected cartridges 4Ka, 4Kb out of the four cartridges 4Ka to 4Kd mounted to the developing unit. Therefore, preparation for the printing is completed when the warm-up of the apparatus and the print preparatory operation on the selected cartridges 4Ka, 4Kb are terminated. Accordingly, since the printing in the above specific color is enabled in a short time, it is possible to prevent the user from waiting needlessly long for the print preparatory operation and to shorten the waiting time of the user.

In the embodiment above, up to four developer cartridges can be mounted to the support frame 40 of the developing unit 4 and the developer cartridges 4Ka to 4Kd are mounted to all the mounting positions, but the present invention may be applied to an apparatus wherein the developer cartridges are mounted to only some of the mounting positions. That is, in an apparatus wherein M ($M \geqq 3$) developer cartridges, less than a mountable number, are mounted to the developing unit 4, as well, N ($M > N \geqq 2$) cartridges out of the M developer cartridges may be defined as the selected cartridges so as to conduct the print preparatory operation only on the selected cartridges, thereby permitting an efficient production of a great amount of prints in the specific color, bringing the apparatus into a printable state in the specific color in a short time without compelling a user to wait needlessly long.

Further, in the embodiment above, the developer cartridge 4Ka which is the closest to the development position and the developer cartridge 4Kb adjoining the developer cartridge 4Ka are defined as the selected cartridges and the print preparatory operation is conducted on the selected cartridges 4Ka and 4Kb, but the print preparatory operation may be conducted on any of the other developer cartridges. For instance, as described above, since the various information items, such as the consumable article management, relating to the developer cartridges are temporarily stored in the RAM 107 prior to the execution of the print preparatory operation, developer cartridges on which the print preparatory operation is conducted, that is the selected cartridges, may be decided based on some of these information items.

<Second Embodiment>

By the way, in the apparatus arranged as described above, a print preparatory operation is required to be conducted prior to the execution of the printing operation by means of each of the developer cartridges 4Ka to 4Kd.

However, it is inefficient in terms of time and economy to conduct the print preparatory operation on the unusable cartridge. Therefore, in this embodiment, the plural cartridges mounted to the developing unit are each checked to determine whether the cartridge is usable or not (usable/unusable determination step) and then, the print preparatory operation is conducted on the usable cartridges which are determined to be usable (preparatory step). The "usable/unusable determination of cartridge" is to determine whether the printing by means of the cartridge becomes possible or not after the print preparatory operation is conducted thereon. The following determination operation is conducted.

(1) Mounting Determination Operation

The mounting determination operation is an operation to determine whether or not the developer cartridges are assuredly mounted to the support frame 40 of the developing unit 4. Specifically, the determination is made based on data acquired by data transmission/reception between the CPU 101 and the individual memories 91 to 94 via the wireless communications carried out between the main body and the individual developer cartridges. In this respect, (2) suitability determination operation to be described below is performed the same way. It goes without saying that the mounting determination of the developer cartridges may also be done by means of a contact system employing a limit switch or the like, instead of using the non-contact system like that of the wireless communications.

(2) Suitability Determination Operation

The suitability determination operation is an operation to determine whether or not the developer cartridges mounted to the support frame 40 of the developing unit 4 are the developer cartridges containing therein the black toner. According to the embodiment in particular, the monochromatic image forming apparatus is constituted by mounting the black developer cartridge(s) to mounting position(s) for yellow, cyan and/or magenta developer cartridge(s) which are for use in the color image forming apparatus. Accordingly, the embodiment involves a possibility of a user, operator or the like inadvertently mounting a wrong developer cartridge. On this account, the suitability determination operation is conducted to prevent the yellow, cyan or magenta developer cartridge from being mistakenly used.

(3) Life Determination Operation

The life determination operation is an operation to determine whether or not a required amount of toner for performing the printing operation remains in the cartridge mounted to the support frame 40 of the developing unit 4. The occurrence of defects, such as density variations or thin spots in the image formed by the printing operation is obviated by conducting the life determination operation.

In addition, the "print preparatory operation" means an operation or a process to be conducted on the usable developer cartridge prior to the execution of the printing operation in order to enable the printing operation by means of the usable cartridge. In this embodiment, the following processes are conducted as the "print preparatory operation".

(a) Agitation Process

The agitation process is a process to cause the developing roller 44 equivalent to the "toner carrier" of the present invention to rotate at least one round. The reason for conducting the agitation process is described above.

Consequently, in the image forming apparatus of this embodiment, an "agitation demanding" signal is generated to cause the developing roller 44 to idle when a condition of arising the shutdown-induced banding phenomenon is satisfied, like when the duration of the standstill exceeds a predetermined time period. Specifically, a rotary driver (not shown) in the main body causes the developing roller 44 to rotate at least one round. Thus, since the toner layer on the surface of the developing roller 44 is refreshed so that a toner layer of a more consistent thickness may be used for the developing process, the density variations due to the shutdown-induced banding phenomenon are less likely to occur.

(b) Patch Process (Condition Control Process)

The patch process is an optimization process to adjust a printing operation condition to a predetermined optimum condition, the printing operation condition under which the printing operation is performed by means of the developing cartridge. This process is the same as those that have heretofore been used widely in the art for stabilizing the image quality. In this embodiment, a "patch control demanding" signal is generated at a suitable time immediately after turn-on of the apparatus so as to carry out the patch process in parallel with the warm-up of the apparatus. In addition, the "patch control demanding" signal is also generated at time when the sleep mode is cancelled, when an opened apparatus cover is closed, or when an operation of replacing the developer cartridge is completed, thus demanding the execution of the patch process.

Next, a pre-print process conducted prior to the printing process in the apparatus shown in FIG. 1 is described with reference to FIGS. 7 through 9. In the interest of promoting the comprehension of the contents of the invention, the description is made on the case where, as shown in FIG. 1, the four developer cartridges 4Ka to 4Kd are mounted to the developing unit 4.

Figure 7:
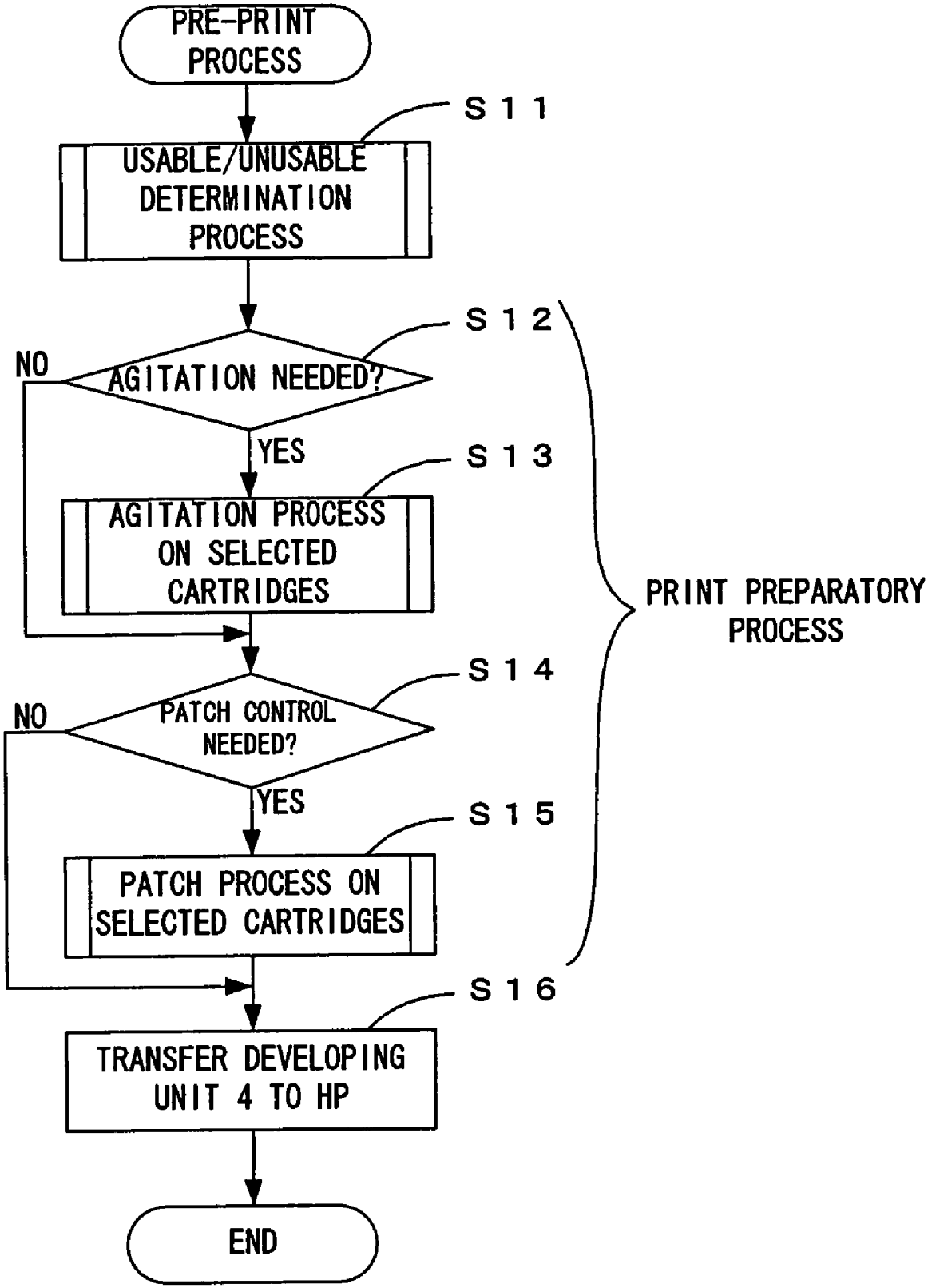
FIG. 7 is a flow chart showing a second embodiment of an image forming apparatus according to the present invention.

FIG. 7 is a flow chart showing a pre-print process conducted in the image forming apparatus of FIG. 1. FIG. 8 is a schematic diagram showing a pre-print operation. In this apparatus, at a proper time prior to the execution of the printing operation, for example, immediately after the turn-on of the apparatus, the CPU 101 controls the individual parts of the apparatus according to a program stored in the ROM 106, thereby carrying out the pre-print process (a usable/unusable determination process and a print preparatory process) shown in FIG. 7 in parallel with the warm-up of the apparatus. That is, in this embodiment, the CPU 101 functions as a "controller" of the present invention.

First, the data transmission/reception between the CPU 101 and each of the memories 91 to 94 is carried out via the wireless communications, so that a variety of information items, such as the consumable article management, relating to the individual developer cartridges 4Ka to 4Kd are temporarily stored in the RAM 107. Then, based on the information stored in the memory 107, the usable/unusable determination process shown in FIG. 9 is conducted on all the developer cartridges 4Ka to 4Kd (Step S11).

Figure 9:
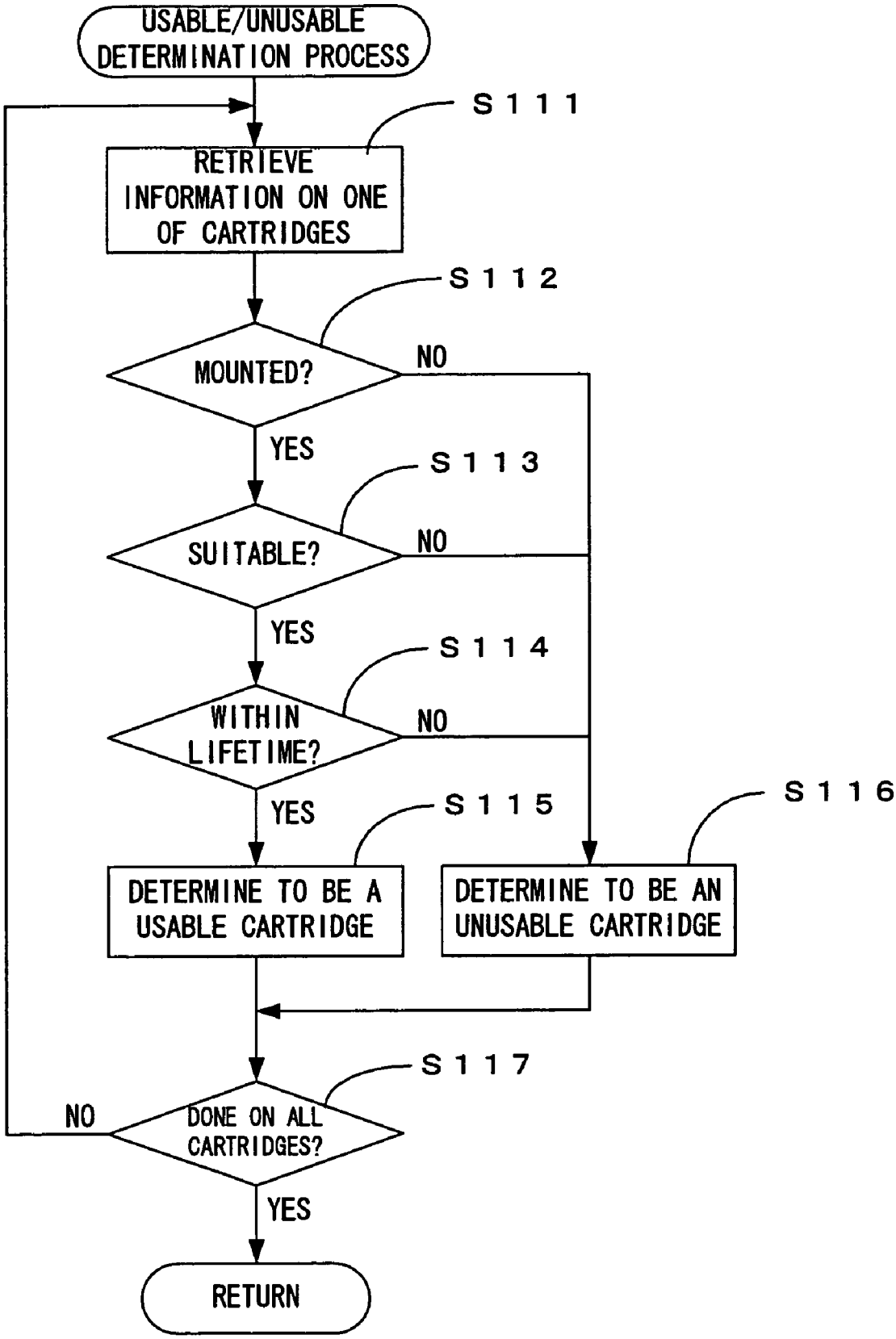
FIG. 9 is a flow chart showing a usable/unusable determination process conducted in the second embodiment.

FIG. 9 is a flow chart showing the usable/unusable determination process. In the usable/unusable determination process, the information on one of the developer cartridges is retrieved from the memory 107 (Step S111), then, a mounting determination operation (Step S112), a suitability determination operation (Step S113), and a life determination operation (Step S114) are conducted (column (a) of FIG. 8). A developer cartridge having passed all the mounting determination, the suitability determination, and the life determination is determined as a usable cartridge (Step S115), and a developer cartridge having failed to pass any one of the above determination operations, on the other hand, is determined as an unusable cartridge (Step S116). Such a series of operations are repeated so long as the result of the determination in Step S117 is "NO", thus, the determinations are made on all the developer cartridges 4Ka to 4Kd. In column (b) of FIG. 8, the developer cartridges 4Ka to 4Kc out of the four developer cartridges 4Ka to 4Kd are determined as the usable cartridges, whereas the remaining cartridge 4Kd is determined as the unusable cartridge. Based on the determination results, the developer cartridge 4Ka that is the closest to the development position, and the developer cartridge 4Kb adjoining the developer cartridge 4Ka are defined as the "selected cartridges" of the, present invention. Hence, the next print preparatory process (Steps S12 to S15) is conducted on the selected cartridges 4Ka, 4Kb.

In the print preparatory process, as shown in FIG. 7, determination is made in Step S12 as to whether the "agitation demanding" signal is generated or not. This is a process for preventing the shutdown-induced banding phenomenon. Therefore, if the "agitation demanding" signal is not generated, the control proceeds directly to Step S14, and if the signal is generated on the other hand, an agitation process (Step S13) is conducted on the selected cartridges 4Ka, 4Kb. This agitation process is the same as that conducted in the first embodiment (Step S5).

When the agitation process (Step S13) is completed, the control proceeds to Step S14 to determine whether the "patch control demanding" signal is generated or not. This is a process to adjust the printing operation condition to the predetermined optimum condition. Therefore, if the "patch control demanding" signal is not generated, the print preparatory process is terminated, and if the signal is generated on the other hand, the patch process (Step S15) is conducted on the selected cartridges 4Ka, 4Kb. This patch process is the same as that conducted in the first embodiment (Step S7).

By conducting such a print preparatory operation (the agitation process, the patch process), all the selected cartridges 4Ka, 4Kb are placed in the printable state in which the printing operation is conducted satisfactory, as shown in column (e) of FIG. 8. Then, the developing unit 4 is transferred to a home position (HP) and stands ready (Step S16). Then, the execution of the image forming operation by the engine section EG is permitted. The subsequent printing operation is performed under the optimum conditions, thereby ensuring that images of a desired image quality can be formed in a stable manner.

As described above, according to this embodiment, the four developer cartridges 4Ka to 4Kd mounted to the developing unit 4 are each checked prior to the execution of the printing operation to determine whether the cartridge is usable or not. Subsequently, the two developer cartridges 4Ka, 4Kb out of the usable cartridges determined to be usable are defined as the selected cartridges and the print preparatory operation is conducted only on the selected cartridges 4Ka, 4Kb to bring the cartridges into a printable state. Therefore, the print preparatory operation on the unusable cartridge is assuredly prevented, thereby increasing the efficiency in terms of time and economy. Furthermore, even if the residual quantity of toner contained in the cartridge 4Ka runs too low to continue the printing operation while performing the printing operation using the developer cartridge 4Ka which is one of the selected cartridges 4Ka, 4Kb on which the print preparatory operation has been already conducted, for example, it is possible to continue the printing operation by immediately switching to the developer cartridge 4Kb. Thus, since the print preparatory operation is previously conducted on the selected cartridges 4Ka and 4Kb, it is possible to continue the printing operation using the toner contained in each of the selected cartridges while selectively switching from one to the other of the selected cartridges 4Ka and 4Kb. Accordingly, a large volume of monochromatic prints can be produced efficiently.

Further, in parallel with the warm-up operation of the apparatus, the print preparatory operation is conducted only on the two selected cartridges 4Ka, 4Kb out of the three usable cartridges 4Ka to 4Kc mounted to the developing unit. Therefore, preparation for the printing is completed when the warm-up of the apparatus and the print preparatory operation on the selected cartridges 4Ka, 4Kb are terminated. Accordingly, since the printing in the above specific color is enabled in a short time, it is possible to prevent the user from waiting needlessly long for the print preparatory operation and to shorten the waiting time of the user.

In an apparatus wherein the developer cartridges less than the mountable number but not less than three are mounted to the developing unit 4, as well, all these developer cartridges are each checked to determine whether the cartridge is usable or not, N ($M>N\geqq 2$) cartridges out of the M ($M\geqq 3$) developer cartridges determined to be usable are defined as the selected cartridges, and the print preparatory operation is conducted only on the selected cartridges, thereby permitting an efficient production of a great amount of prints in the specific color, bringing the apparatus into a printable state in the specific color in a short time without compelling a user to wait needlessly long.

Further, in the above embodiment, although the developer cartridge 4Ka located closest to the development position and the developer cartridge 4Kb adjoining the developer cartridge 4Ka are defined as the selected cartridges on which the print preparatory operation is conducted, the print preparatory operation may be conducted on other developer cartridges. For instance, as described above, since the various information items, such as the consumable article management, relating to the developer cartridges are temporarily stored in the RAM 107 prior to the execution of the usable/unusable determination process, the usable cartridge on which the print preparatory operation is conducted, that is, the selected cartridges may be decided based on some of these information items (e.g., the information on the residual quantity of toner). Further, the cartridges may be graded in multiple levels on the amount of toner remaining in the cartridge, and the cartridge of a specified grade may be preferentially decided to be the selected cartridges.

<Others>

It is to be noted that the present invention is not limited to the foregoing embodiments and various changes and modifications other than the above may be made thereto unless such changes and modifications v:depart from the scope of the invention. For instance, in the foregoing embodiments, up to four developer cartridges can be mounted to the support frame 40 of the developing unit 4 and the developer cartridges 4Ka to 4Kd are mounted to all the mounting positions, but the present invention may be applied to an apparatus wherein the developer cartridges are mounted to only some of the mounting positions. Further, although the number of the mountable cartridges is four in the foregoing embodiments, the number is arbitrary. And the number M is also arbitrary on the condition that the number is not less than three and not more than the number of the mountable cartridges. Therefore, the present invention is also applicable to an image forming apparatus, for example, wherein the developing unit 4 is designed to allow six or more developer cartridges to be mounted to the support frame 40, wherein the yellow, cyan and magenta developer cartridges are mounted to three mounting positions, and wherein the black developer cartridges are mounted to the rest of the mounting positions.

Figure 10:
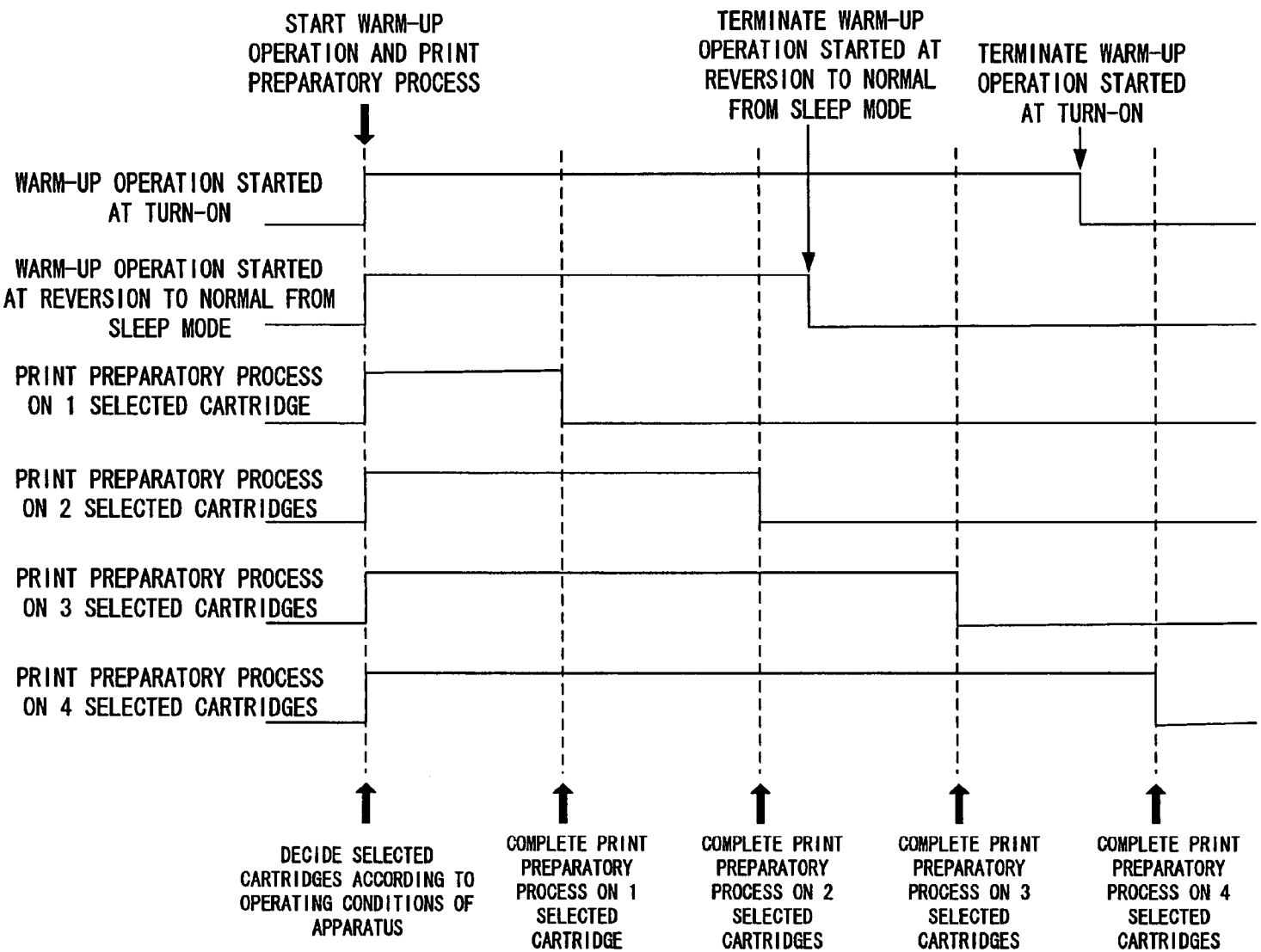
FIG. 10 is a chart showing a relation between warm-up operation and the print preparatory process in the apparatus of FIG. 1.

Further, in the foregoing embodiments, although the number of the selected cartridges is two, the number N of the selected cartridges may be decided according to the operating conditions of the apparatus. Now referring to FIG. 10, a detailed description is made on a concept of deciding the number N of the selected cartridges. FIG. 10 is a chart showing an exemplary relation between time required to warm up the apparatus according to the operating conditions thereof and time required to accomplish the print preparatory process corresponding to the number of the selected cartridges.

In the apparatus having the relation shown in FIG. 10, the print preparatory process on three developer cartridges (selected cartridges) is accomplished within a length of time required to warm up the apparatus at turn-on, and the print preparatory process on two developer cartridges (selected cartridges) is accomplished within a length of time required to warm up the apparatus at reversion to normal mode from sleep mode. In such a case where the warm-up times allow the print preparatory operation to be conducted on different numbers of cartridges, the number N of the selected cartridges may be decided in consideration of the length of time required to warm up the apparatus immediately after turn-on of the apparatus or at reversion to normal mode from sleep mode, or the like. In other words, the number N of the selected cartridges may be defined as the maximum number of cartridges that the print preparatory operation can finish within the length of time required to warm up the apparatus. This prevents the apparatus from compelling the user to wait needlessly long before the warm-up of the apparatus and the print preparatory operation on the cartridge(s) are completed to place the apparatus in the printable state, and this also provides for an efficient production of a large volume of prints.

It goes without saying that as the operating conditions to consider in deciding the number N of the selected cartridges, not only the turn-on of the apparatus or the reversion to normal mode from sleep mode described above, but also the temperature of the fixing unit or other various conditions may be considered. Further, in the apparatus according to the second embodiment, since the usable/unusable determination process is conducted using the information stored in the memory, time required to accomplish the usable/unusable determination process is much shorter than time required to accomplish the print preparatory process. Therefore, in a case where such an apparatus has the relation shown in FIG. 10, the time required to accomplish the usable/unusable determination process is not taken into consideration when the number N of the selected cartridges is decided. As a matter of course, however, it is also possible to decide the number N of the selected cartridges in consideration of the time required to accomplish the usable/unusable determination process.

Further, in the foregoing embodiments, although the present invention is applied to the image forming apparatus defining the specific color as black, the specific color is not limited to this.

Further, in the foregoing embodiments, the rotary development system is adopted wherein a plurality of developer cartridges are mounted to the developing unit 4, so that the toner contained in the individual developer cartridges is agitated in the cartridges in conjunction with the rotating movement of the developing unit 4, thereby homogenizing the toner. Consequently, toner agitation by way of the rotating operation of the developing unit 4 may be conducted as the print preparatory operation. Further, it has been a conventional practice to adopt a technique wherein a member such as an agitator or an auger rod is disposed in the developer cartridge for agitating the toner in the developer cartridge or for actively feeding the toner to the developing roller. Consequently, in an apparatus equipped with the member such as the agitator or the auger rod, the toner agitation or the toner feeding by means of the member may be conducted as the print preparatory operation.

Further, in the foregoing embodiments, although an arrangement is adopted to use up the toner contained in the developer cartridge, in an apparatus employing a developer cartridge of a type to be replenished with the toner as needed, a toner replenishment operation may also be conducted as the print preparatory operation.

Further, in the foregoing embodiments, although the four developer cartridges 4Ka to 4Kd having the same configuration are used, it is also possible to employ developer cartridges having configurations different from each other. Further, in the foregoing embodiments, the present invention is applied to the image forming apparatus of a so-called rotary system, wherein the rotary developing unit 4 is disposed against one photosensitive member 22, but the present invention may also be applied to an image forming apparatus of an elevator system wherein a plurality of developer cartridges are moved up and down relative to one photosensitive member 22 for carrying out the development process, or an image forming apparatus of a so-called tandem system.

Furthermore, the present invention is not limited to the arrangements of the foregoing embodiments, but applicable to, for example, an apparatus which is equipped with a developing unit to which a plurality of developer cartridges having toner of a specific color are mounted and which forms an image of the specific color, an apparatus which is equipped with a transfer medium other than the intermediate transfer belt (such as a transfer drum or a transfer sheet), and other image forming apparatuses such as copiers and facsimiles.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a latent image carrier capable of carrying thereon an electrostatic latent image;

a developing unit having a plurality of cartridges which are freely mounted to and removed from said developing unit and which contain toner of a specific color; and a controller which performs a printing operation to selectively position one of the plurality of cartridges mounted to said developing unit at a development position and to develop the electrostatic latent image on said latent image carrier using the toner in the cartridge positioned at the development position, wherein said controller defines N ($M>N\geqq 2$) cartridges out of M ($M\geqq 3$) cartridges mounted to said developing unit as selected cartridges and conducts a print preparatory operation prior to the printing operation only on the selected cartridges, the print preparatory operation conducted on the selected cartridges in order to enable the printing operation by means of the selected cartridges.

2. The image forming apparatus of claim 1, wherein said controller conducts, as the print preparatory operation, a mounting confirmation operation to confirm that the selected cartridges are mounted to said developing unit.

3. The image forming apparatus of claim 1, wherein said controller conducts, as the print preparatory operation, a suitability confirmation operation to confirm that each of the selected cartridges mounted to said developing unit have the toner of the specific color.

4. The image forming apparatus of claim 1, wherein said controller conducts, as the print preparatory operation, a life confirmation operation to confirm that a required amount of toner to perform the printing operation remains in each of the selected cartridges mounted to said developing unit.

5. The image forming apparatus of claim 1, wherein said controller checks each of the plurality of cartridges mounted to said developing unit to determine whether the cartridge is usable or not, and when M ($M\geqq 3$) cartridges are determined to be usable, defines N ($M>N\geqq 2$) cartridges out of the M ($M\geqq 3$) cartridges as the selected cartridges.

6. The image forming apparatus of claim 5, wherein said controller determines whether the cartridge is usable or not based on whether the cartridge is mounted to said developing unit or not.

7. The image forming apparatus of claim 5, wherein said controller determines whether the cartridge is usable or not based on whether the cartridge mounted to said developing unit has the toner of the specific color or not.

8. The image forming apparatus of claim 5, wherein said controller determines whether the cartridge is usable or not based on whether or not a required amount of toner to perform the printing operation remains in the cartridge mounted to said developing unit.

9. The image forming apparatus of claim 1, wherein each of the plurality of cartridges comprises a toner carrier which rotates in a predetermined direction while carrying toner on its surface thereby conveying the toner to a position opposite to said latent image carrier, and said controller conducts, as the print preparatory operation, an agitation process to cause the toner carrier to rotate at least one round.

10. The image forming apparatus of claim 1, wherein said controller conducts, as the print preparatory operation, a condition control process to adjust a printing operation condition to a predetermined optimum condition, the printing operation condition under which the printing operation is performed by means of the cartridge mounted to said developing unit.

11. The image forming apparatus of claim 1, wherein a number of cartridges mountable to said developing unit is more than M ($M\geqq 3$).

12. The image forming apparatus of claim 1, wherein said controller decides the number N of the selected cartridges according to operating conditions of the apparatus.

13. An image forming method of an apparatus which comprises a latent image carrier capable of carrying thereon an electrostatic latent image, and a developing unit having a plurality of cartridges which are freely mounted to and removed from said developing unit and which contain toner of a specific color, said method comprising:

a step of executing a printing operation to selectively position one of the plurality of cartridges mounted to said developing unit to a development position, and to develop the electrostatic latent image on said latent image carrier using the toner in the cartridge positioned at the development position, a step of defining N ($M>N\geqq 2$) cartridges out of M ($M\geqq 3$) cartridges mounted to said developing unit as selected cartridges prior to the printing operation, and a step of conducting a print preparatory operation prior to the printing operation only on the selected cartridges, the print preparatory operation conducted on the selected cartridges to enable the printing operation by means of the selected cartridges.

14. The image forming method of claim 13, further comprising:

a step of checking each of the plurality of cartridges mounted to said developing unit to determine whether the cartridge is usable or not prior to the conduct of the print preparatory operation, wherein when M ($M\geqq 3$) cartridges are determined to be usable, N ($M>N\geqq 2$) cartridges out of the M ($M\geqq 3$) cartridges are decided as the selected cartridges.

* * * * *